US012442275B2

(12) United States Patent
Baruah et al.

(10) Patent No.: US 12,442,275 B2
(45) Date of Patent: Oct. 14, 2025

(54) WIRELINE RETRIEVABLE ANNULAR PRESSURE BLEEDER

(71) Applicant: SAUDI ARABIAN OIL COMPANY, Dhahran (SA)

(72) Inventors: Keshabananda Baruah, Abqaiq (SA); Sanjiv Kumar, Dhanbad (IN); Mansour M. Almaghlouth, Dammam (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/478,598

(22) Filed: Sep. 29, 2023

(65) Prior Publication Data

US 2025/0109653 A1 Apr. 3, 2025

(51) Int. Cl.
*E21B 34/08* (2006.01)

(52) U.S. Cl.
CPC ..... *E21B 34/08* (2013.01)

(58) Field of Classification Search
CPC ..... E21B 34/08; E21B 43/123
See application file for complete search history.

(56) References Cited

U.S. PATENT DOCUMENTS 4,333,527 A * 6/1982 Higgins ..... E21B 43/123 166/117.5
H635 H * 6/1989 Johnson ..... E21B 41/02 166/310
4,901,798 A 2/1990 Amani
4,976,314 A * 12/1990 Crawford ..... E21B 23/03 166/117.5
5,316,086 A 5/1994 DeMoss
5,806,599 A 9/1998 Hisaw et al.
6,491,105 B2 * 12/2002 Holt, Jr. ..... E21B 43/123 166/321
8,162,060 B2 4/2012 Randazzo
10,156,130 B2 12/2018 Kamphaus et al.
(Continued)

FOREIGN PATENT DOCUMENTS

CN 108843272 A 11/2018
CN 208966268 U 6/2019
(Continued)

*Primary Examiner* — D. Andrews
(74) *Attorney, Agent, or Firm* — Osha Bergman Watanabe & Burton LLP

(57) ABSTRACT

An apparatus includes a pocket portion disposed on production tubing, the pocket portion defining a volume therewithin, wherein the volume is in fluid communication with an interior of the production tubing. The pocket portion includes a valve arrangement that permits unidirectional fluid flow between a tubing-casing annulus and the volume. The apparatus also includes a pressure bleeder configured to be selectively mounted within the pocket portion. The pressure bleeder is configured to permit fluid flow between the valve arrangement and the interior of the production tubing only above a predetermined threshold pressure. A related method includes: providing the pocket portion and valve arrangement; mounting the pressure bleeder within the pocket portion; and, with the pressure bleeder, permitting fluid flow between the valve arrangement and the interior of the production tubing only above a predetermined threshold pressure.

20 Claims, 9 Drawing Sheets

(56) References Cited

U.S. PATENT DOCUMENTS

| | | | | |
|---|---|---|---|---|
| 11,441,386 | B2 | 9/2022 | Zahur et al. | |
| 11,555,388 | B2 | 1/2023 | Stojkovic et al. | |
| 2006/0137881 | A1* | 6/2006 | Schmidt | E21B 43/123 166/372 |

FOREIGN PATENT DOCUMENTS

| | | | |
|---|---|---|---|
| EP | 0 880 638 | A1 | 12/1998 |
| EP | 2 702 239 | A2 | 3/2014 |

* cited by examiner

WIRELINE RETRIEVABLE ANNULAR PRESSURE BLEEDER

BACKGROUND

Generally, at a completed wellbore, the "tubing-casing annulus" (TCA) is understood as the annular space between production tubing string and a surrounding wellbore casing. The TCA is usually isolated from a hydrocarbon reservoir by a packer that may be installed further downhole between the tubing and casing.

Conventionally, a TCA may be filled with fluid, such as diesel or brine, once isolated, and is often utilized for such purposes as gas lift, chemical injection, well killing operations and well integrity monitoring. When a well on-site goes into production for the first time, thermal expansion of the TCA fluid is expected due to heat exchange from higher-temperature reservoir fluid in the production tubing. Generally, it is understood that the TCA pressure should not exceed a predetermined maximum allowable pressure, usually determined through prior testing and/or a pressure rating of materials used.

If TCA pressure is not monitored and excess pressure is not bled off, it can lead to failure (such as burst or collapse) of the production tubing, casing or other components. Therefore, conventional practice involves monitoring the well during initial start-up (that is, initial production after drilling or workover) and, if needed, releasing any excess pressure from the TCA. Moreover, the well may be visited at regular intervals during production to ensure that TCA pressure is less than the maximum allowable pressure, and excess pressure again is bled off if necessary.

However, in each of these cases, bleed-off is handled by opening a TCA gate valve and venting a portion of the TCA fluid to atmosphere. The volume of the vented fluid can then vary depending on the TCA cavity volume and pressure in the annulus. Such an approach involves several disadvantages, including compromised worker safety, impeded production and further harm to the environment.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to an apparatus including a pocket portion disposed on production tubing, the pocket portion defining a volume therewithin, wherein the volume is in fluid communication with an interior of the production tubing. The pocket portion includes a valve arrangement that permits unidirectional fluid flow between a tubing-casing annulus and the volume. The apparatus also includes a pressure bleeder configured to be selectively mounted within the pocket portion. The pressure bleeder is configured to permit fluid flow between the valve arrangement and the interior of the production tubing only above a predetermined threshold pressure.

In one aspect, embodiments disclosed herein relate to a method that includes: providing a pocket portion on production tubing, the pocket portion defining a volume therewithin, wherein the volume is in fluid communication with an interior of the production tubing; providing in the pocket portion a valve arrangement that permits unidirectional fluid flow between a tubing-casing annulus and the volume; mounting a pressure bleeder within the pocket portion; and with the pressure bleeder, permitting fluid flow between the valve arrangement and the interior of the production tubing only above a predetermined threshold pressure.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein are directed to a wireline retrievable annular pressure bleeder designed to bleed off Tubing-Casing Annulus (TCA) pressure into the wellbore automatically and in a safe manner. Specifically, embodiments disclosed herein involve installing the annular pressure bleeder along the tubing in the vertical section of the completion during well completion. The annular pressure bleeder consists of pub joint which is designed to receive a pressure relief valve (PRV) which can be installed and retrieved by normal wireline operation. The pub joint is connected to other tubing via threaded couplings. The annular pressure bleeder assembly also includes a non-return check valve which allows unidirectional flow from annulus to tubing only. The system is designed to actuate or open the PRV when the annular pressure reaches a certain pressure. In this way, pressure in the TCA is relieved or vented into the wellbore.

Figure 1:
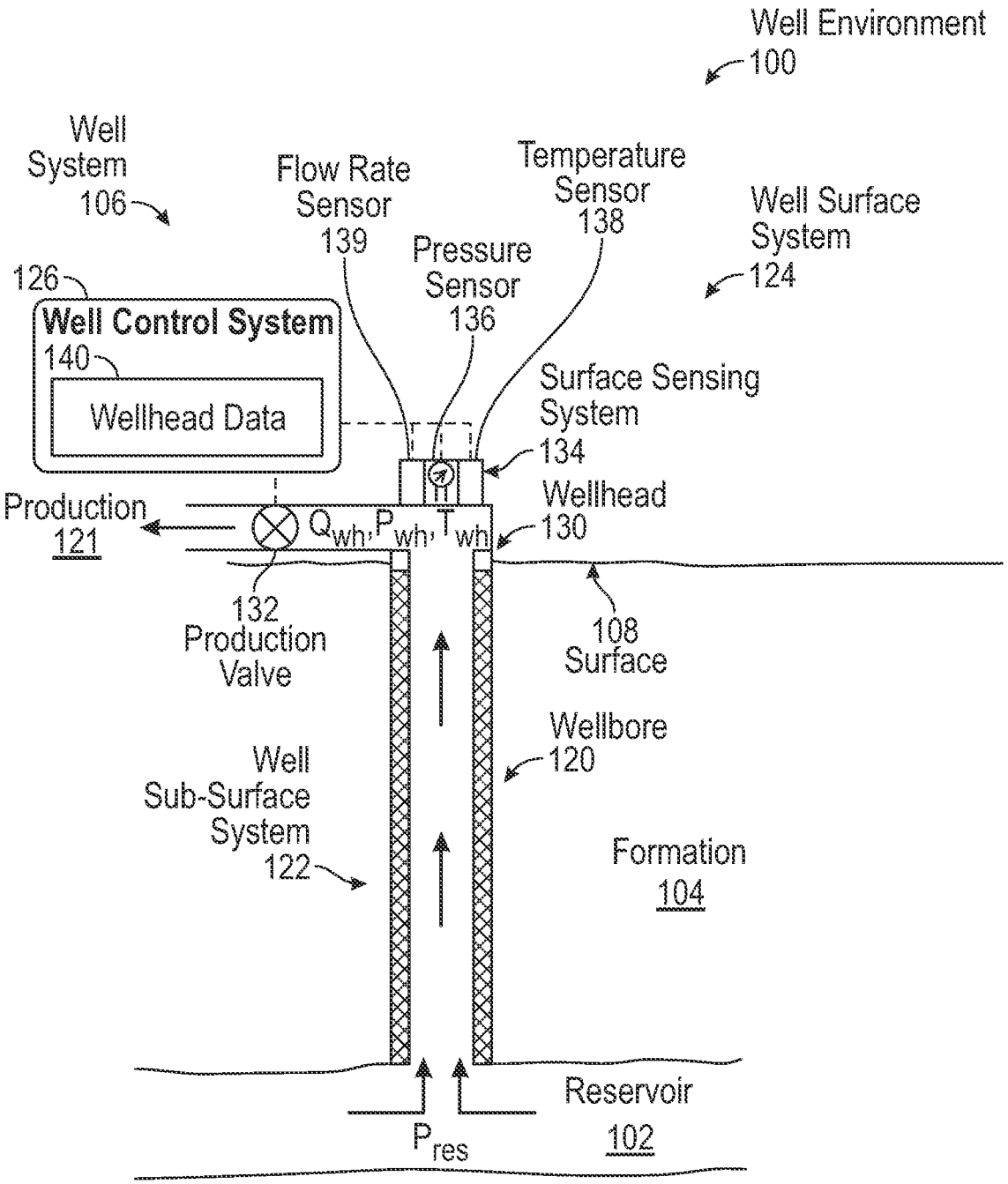
FIG. 1 schematically illustrates, in a cross-sectional elevational view, a conventional wellbore and well control system by way of general background and in accordance with one or more embodiments.
Figure 2:
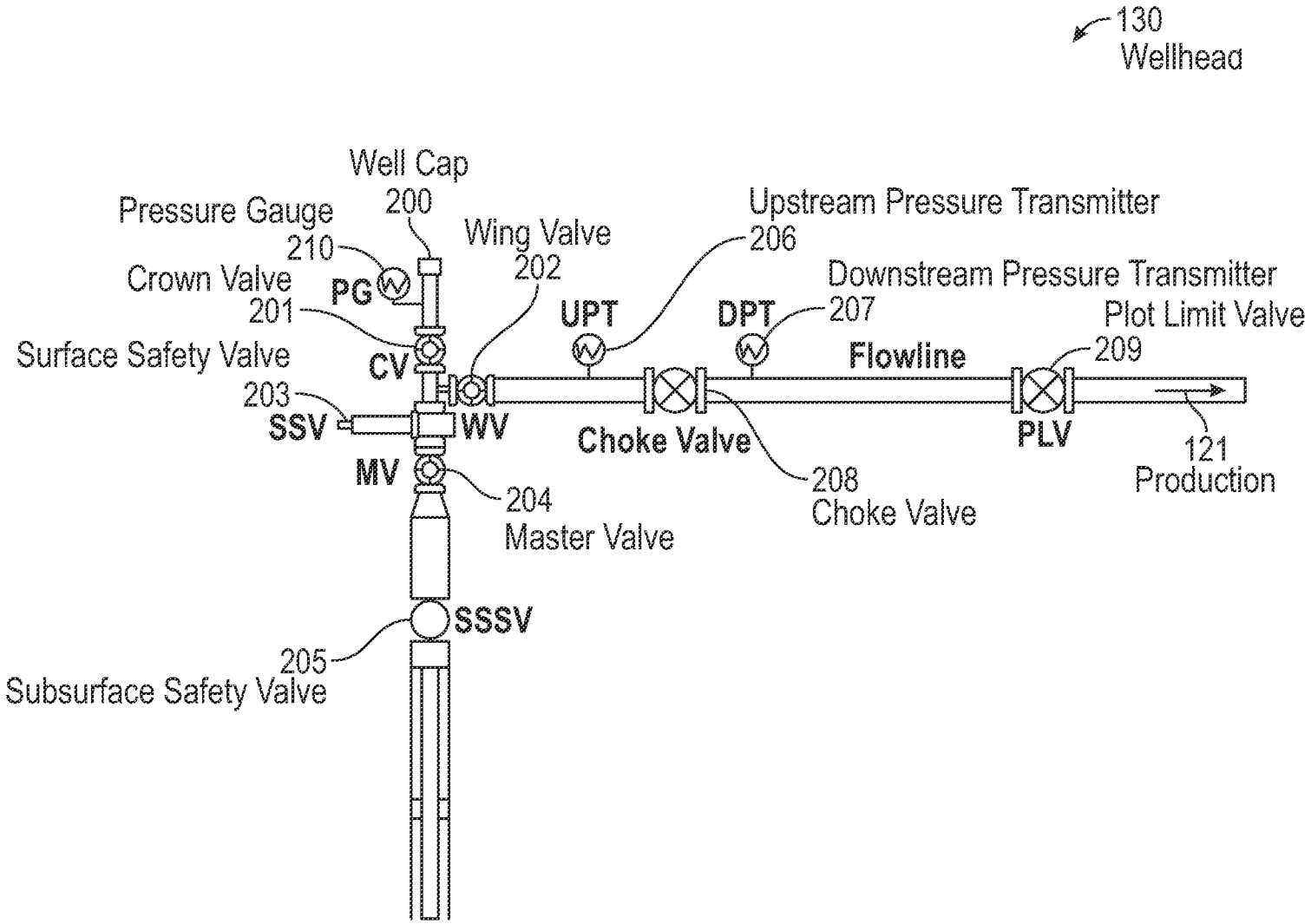
FIG. 2 illustrates, in elevational view, a wellhead, and related components, employed for the wellbore and well control system of FIG. 1, by way of general background and in accordance with one or more embodiments.

In accordance with one or more embodiments, FIGS. 1 and 2 illustrate a general environment in which one or more embodiments may be employed. Thus, FIG. 1 schematically illustrates, in a cross-sectional elevational view, a wellbore and a well control system in accordance with one or more embodiments. The well system 106 includes a wellbore 120, a well sub-surface system 122, a well surface system 124, and a well control system ("control system") 126. The control system 126 may control various operations of the well system 106, such as well production operations, well completion operations, well maintenance operations, and reservoir monitoring, assessment and development operations. The control system 126 includes a computer system that can be the same as, or is in communication with, computer system 885 described below in FIG. 8.

In accordance with one or more embodiments, the wellbore 120 includes a bored hole that extends from the surface 108 into a target zone of the formation 104, such as the reservoir 102. An upper end of the wellbore 120, terminating at or near the surface 108, may be referred to as the "up-hole" end of the wellbore 120, and a lower end of the wellbore, terminating in the formation 104, may be referred to as the "down-hole" end of the wellbore 120. The wellbore 120 facilitates the circulation of drilling fluids during drilling operations, the flow of hydrocarbon production ("production") 121 (e.g., oil and gas) from the reservoir 102 to the surface 108 during production operations, the injection of substances (e.g., water) into the formation 104 or the reservoir 102 during injection operations, or the communication of monitoring devices (e.g., logging tools) into the formation 104 or the reservoir 102 during monitoring operations (e.g., during in situ logging operations).

In accordance with one or more embodiments, during operation of the well system 106, the control system 126 collects and records wellhead data 140 for the well system 106. The wellhead data 140 may include, for example, a record of measurements of wellhead pressure ($P_{wh}$) (e.g., including flowing wellhead pressure), wellhead temperature ($T_{wh}$) (e.g., including flowing wellhead temperature), wellhead production rate ($Q_{wh}$) over some or all of the life of the well 106, and water cut data. Such measurements may be recorded in real-time, to be available for review or use within seconds, minutes, or hours of the condition being sensed (e.g., within one hour). Such real-time data can help an operator of the well 106 to assess a relatively current state of the well system 106, and make real-time decisions regarding development of the well system 106 and the reservoir 102, such as on-demand adjustments in regulation of production flow from the well.

In accordance with one or more embodiments, the well sub-surface system 122 includes a casing installed in the wellbore 120. For example, the wellbore 120 may have a cased portion and an uncased (or "open-hole") portion. The cased portion may include a portion of the wellbore having casing (e.g., casing pipe and casing cement; see, e.g., 342 in FIG. 3) disposed therein. The uncased portion may include a portion of the wellbore not having casing disposed therein. In embodiments having a casing, the casing defines a central passage that provides a conduit for the transport of tools and substances through the wellbore 120. For example, the central passage may provide a conduit for lowering logging tools into the wellbore 120, a conduit for the flow of production 121 (e.g., oil and gas) from the reservoir 102 to the surface 108, or a conduit for the flow of injection substances (e.g., water) from the surface 108 into the formation 104. The well sub-surface system 122 can include production tubing installed in the wellbore 120. The production tubing may provide a conduit for the transport of tools and substances through the wellbore 120. The production tubing may, for example, be disposed inside casing. In such an embodiment, the production tubing may provide a conduit for some or all of the production 121 (e.g., oil and gas) passing through the wellbore 120 and the casing.

In accordance with one or more embodiments, the well surface system 124 includes a wellhead 130. The wellhead 130 may include a rigid structure installed at the "up-hole" end of the wellbore 120, at or near where the wellbore 120 terminates at the Earth's surface 108. The wellhead 130 may include structures (called "wellhead casing hanger" for casing and "tubing hanger" for production tubing) for supporting (or "hanging") casing and production tubing extending into the wellbore 120. Production 121 may flow through the wellhead 130, after exiting the wellbore 120 and the well sub-surface system 122, including, for example, the casing and the production tubing. The well surface system 124 may include flow regulating devices that are operable to control the flow of substances into and out of the wellbore 120. For example, the well surface system 124 may include one or more production valves 132 that are operable to control the flow of production 121. For instance, a production valve 132 may be fully opened to enable unrestricted flow of production 121 from the wellbore 120, the production valve 132 may be partially opened to partially restrict (or "throttle") the flow of production 121 from the wellbore 120, and production valve 132 may be fully closed to fully restrict (or "block") the flow of production 121 from the wellbore 120, and through the well surface system 124.

In accordance with one or more embodiments, the wellhead 130 includes a choke assembly. For example, the choke assembly may include hardware with functionality for opening and closing the fluid flow through pipes in the well system 106. Likewise, the choke assembly may include a pipe manifold that may lower the pressure of fluid traversing the wellhead. As such, the choke assembly may include set of high pressure valves and at least two chokes. These chokes may be fixed or adjustable or a mix of both. Redundancy may be provided so that if one choke has to be taken out of service, the flow can be directed through another choke. In some embodiments, pressure valves and chokes are communicatively coupled to the well control system 126. Accordingly, a well control system 126 may obtain wellhead data regarding the choke assembly as well as transmit one or more commands to components within the choke assembly in order to adjust one or more choke assembly parameters.

In accordance with one or more embodiments, the well surface system 124 includes a surface sensing system 134. The surface sensing system 134 may include sensors for sensing characteristics of substances, including production 121, passing through or otherwise located in the well surface system 124. The characteristics may include, for example, pressure, temperature and flow rate of production 121 flowing through the wellhead 130, or other conduits of the well surface system 124, after exiting the wellbore 120.

In accordance with one or more embodiments, the surface sensing system 134 includes a surface pressure sensor 136 operable to sense the pressure of production 121 flowing through the well surface system 124, after it exits the wellbore 120. The surface pressure sensor 136 may include, for example, a wellhead pressure sensor that senses a pressure of production 121 flowing through or otherwise located in the wellhead 130. In some embodiments, the surface sensing system 134 includes a surface temperature sensor 138 operable to sense the temperature of production 121 flowing through the well surface system 124, after it exits the wellbore 120. The surface temperature sensor 138 may include, for example, a wellhead temperature sensor that senses a temperature of production 121 flowing through or otherwise located in the wellhead 130, referred to as "wellhead temperature" ($T_{wh}$). In some embodiments, the surface sensing system 134 includes a flow rate sensor 139 operable to sense the flow rate of production 121 flowing through the well surface system 124, after it exits the wellbore 120. The flow rate sensor 139 may include hardware that senses a flow rate of production 121 ($Q_{wh}$) passing through the wellhead 130.

FIG. 2 illustrates, in elevational view, a wellhead, and related components, employed for the wellbore and well control system of FIG. 1, in accordance with one or more embodiments. As such, one or more of the modules and/or elements shown in FIG. 2 may be omitted, repeated, and/or substituted. Accordingly, embodiments of the invention should not be considered limited to the specific arrangements of modules and/or elements shown in FIG. 2.

In accordance with one or more embodiments, FIG. 2 illustrates details of the wellhead 130 and the flowline for the production 121 depicted in FIG. 1 above. As shown, the wellhead 130 includes a well cap 200, a crown valve 201, a wing valve 202, a surface safety valve 203, a master valve 204, a subsurface safety valve 205, an upstream pressure transmitter 206, a downstream pressure transmitter 207, a choke valve 208, and a plot limit valve 209. The crown valve 201, wing valve 202, surface safety valve 203, master valve 204, choke valve 208, and plot limit valve 209 are referred to as valves at the wellhead. In addition, a pressure gauge 210 and/or temperature gauge (not shown) is permanently installed between the crown valve 201 and the well cap 200. The pressure gauge 210 and/or temperature gauge (not shown) correspond to the pressure sensor 136 and temperature sensor 138, respectively, depicted in FIG. 1 above.

In accordance with one or more embodiments, the well cap 200 provides access to wellbore for interventions with wireline, coil tubing, slickline etc. The crown valve 201 is the uppermost valve on wellhead. Typically, the crown valve 201 is closed until there is a need to access the well as described above. The wing valve 202 is for production flow control. In the case of needing to enter a well, this valve would be closed and the master valve would be open. The surface safety valve 203 is typically a hydraulic failsafe close valve located at surface. The surface safety valve 203 is used in the event of an issue in the wellbore/surface equipment and for testing. The master valve 204 is the main valve controlling flow from the wellbore. The subsurface safety valve 205 is another safety device located below the surface, e.g., several hundred plus feet below the surface. The subsurface safety valve 205 makes up part of the production tubing and provides an arrangement for safety closure in the case of uncontrolled release of hydrocarbons, such as a kick. Also, the subsurface safety valve 205 may be used as a barrier when testing or needed to perform maintenance on the wellhead.

In accordance with one or more embodiments, the choke valve 208 is used for flow restriction in the event of bleeding down pressure during testing, loss of pressure in the wellbore, temperature management, etc. The upstream pressure transmitter 206 is a pressure/temperature gauge located upstream of choke valve 208 and provides pressure data prior to reaching the choke valve 208. The downstream pressure transmitter 207 is a pressure/temperature gauge downstream of choke valve 208 and provides pressure data after passing the choke valve 208. The plot limit valve 209 is a valve for testing, maintenance and isolation purposes, e.g., if the upstream pressure transmitter 206, downstream pressure transmitter 207, or choke valve 208 were being replaced. The pressure gauge 210 located above the crown valve 201 is for testing each component of the wellhead. As generally treated herein, shut-in wellhead pressure (SIWHP) refers to the initial wellhead pressure from the reservoir as seen at surface and is a base line pressure for testing purposes, and can be measured by the pressure gauge 210. The initial manifold pressure refers to the initial pressure downstream of wellhead and is a base line pressure for testing purposes.

In one or more embodiments, the hydraulic valves and associated gauges are connected as depicted in FIG. 2. In particular, a pressure gauge 210 can be permanently installed between the well cap 200 and the crown valve 201. In a first open/close configuration, the subsurface safety valve, master valve, wellhead valve, crown valve, and plot limit valve are closed to record the initial manifold pressure using the downstream pressure transmitter.

In accordance with one or more embodiments, following the first open/close configuration and in the second open/close configuration, the subsurface safety valve, master valve, wing valve, and crown valve are opened with the plot limit valve closed to record the initial shut-in wellhead pressure (SIWHP) using the permanently installed pressure gauge between the well cap and the crown valve. The pressure gauge readings of the permanently installed pressure gauge, the upstream pressure transmitter, and the downstream pressure transmitter are compared with each other to validate gauge accuracy. The gauge readings from the downstream pressure transmitter, the upstream pressure transmitter, and the pressure gauge between the well cap and the crown valve are denoted as DPT, UPT, and PG, respectively. All pressure gauge readings are observed for 10 minutes to record pressure changes, if any. If all three following conditions are true over the 10 minutes period: DPT=SIWHP, UPT=SIWHP, and PG=SIWHP, then the plot limit valve is determined as holding (i.e., no leakage).

Following the second open/close configuration and in the third open/close configuration, the wellhead valve is closed and the plot limit valve is opened to observe all pressure gauge readings for 10 minutes and record pressure changes, if any. If both following conditions are true over the 10 minutes period: UPT=initial manifold pressure=DPT and PG=SIWHP, then the wellhead valve is determined as holding (i.e., no leakage).

Following the third open/close configuration and in the fourth open/close configuration, the crown valve is closed followed by closing the master valve and opening the wellhead valve. If both following conditions are true over the 10 minutes period: UPT=initial manifold pressure=DPT and PG=SIWHP, then the crown valve and the master valve are determined as holding (i.e., no leakage).

Subsequent to the first, second, third and fourth open/close configurations, the crown valve is opened to bleed the pressure to a flare pit. Specifically, PLV and WV are open. MV is closed and CV bleeds the trapped pressure between CV and MV into the flare pit.

The disclosure now turns to working examples of a system and method in accordance with one or more embodiments, as described and illustrated with respect to FIGS. 3-8. It should be understood and appreciated that these merely represent illustrative examples, and that a great variety of possible implementations are conceivable within the scope of embodiments as broadly contemplated herein.

Broadly contemplated herein, in accordance with one or more embodiments, is a an annular pressure bleeder, retrievable by a wireline, that is installed to bleed off TCA pressure into the wellbore automatically, and in a manner that is safe and that does not adversely affect production. Thus, as TCA fluid is vented to the wellbore and not to atmosphere, the process is also much more environmentally friendly than conventional methods.

Figure 3:
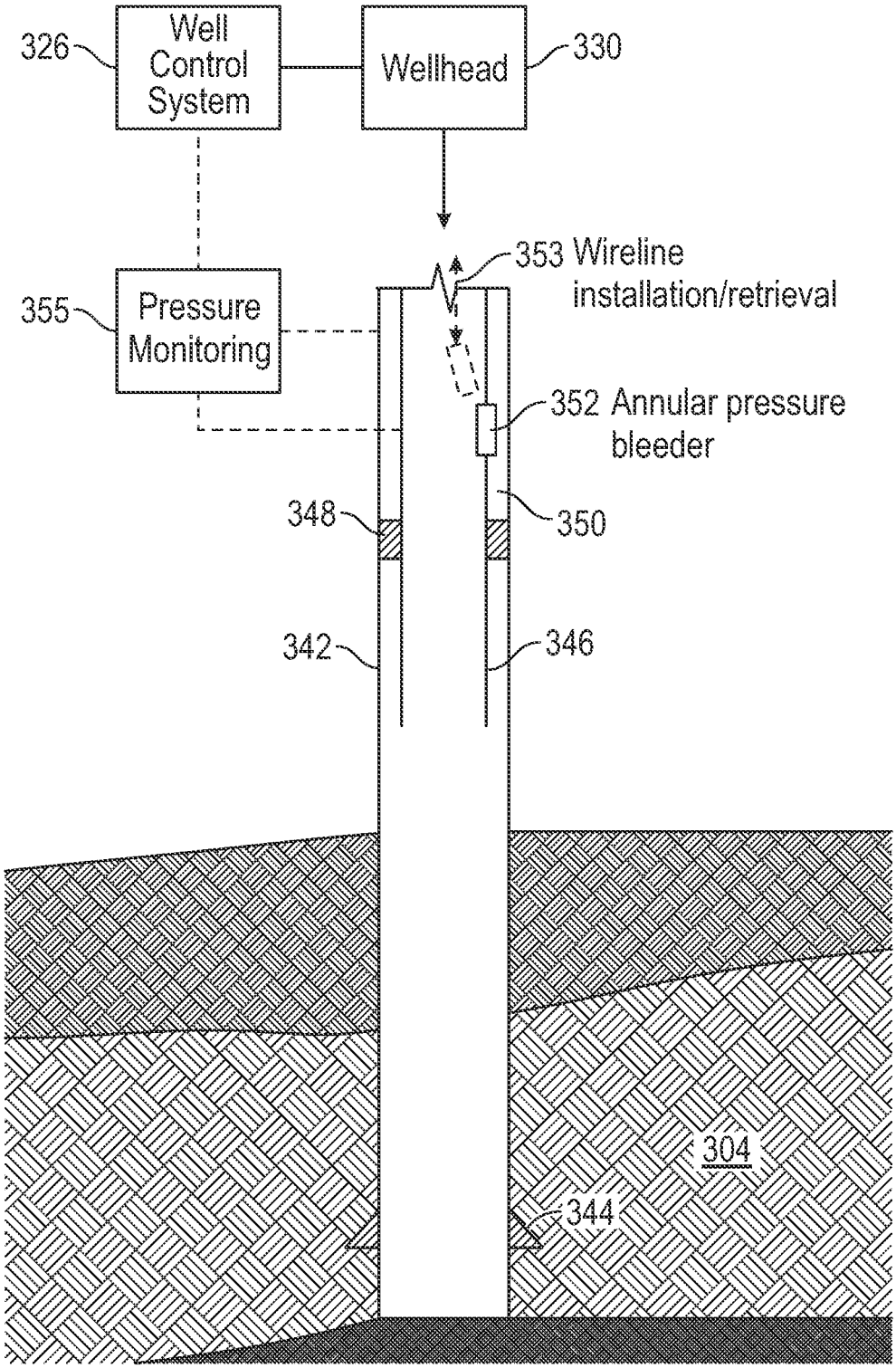
FIG. 3 schematically illustrates, in a cross-sectional elevational view, a production wellbore in accordance with one or more embodiments.

Accordingly, FIG. 3 schematically illustrates, in a cross-sectional elevational view, a production wellbore in accordance with one or more embodiments. In the illustrated working example, a well has been drilled and completed for oil production, with a casing 342 cemented into place and a casing shoe 344 set across formation rock 304 at a predetermined depth. Production tubing 346, for recovering hydrocarbons from the formation rock 304 (or other subsurface regions), is then installed and nested coaxially within the casing 342. Further, as is generally known, a packer 348 may be included to seal the tubing-casing annulus (TCA) 350 between the casing 342 and production tubing 346.

In accordance with one or more embodiments, also illustrated is a wellhead 330 in communication with a well control system 326; these may function and be configured analogously to the wellhead 130 and well control system 126, respectively, that are described and illustrated with respect to FIGS. 1-2. Additionally, an annular pressure bleeder 352, as generally described hereabove, is provided in production tubing 346 and is in communication with the TCA 350 in a manner to be described below. Particularly, annular pressure bleeder 352 may be installed, and may function, in a manner that will be better understood and appreciated from the working example discussed herebelow. For instance, in accordance with an illustrative and non-restrictive example, annular pressure bleeder 352 may be mounted or installed via a wireline 353, into a pocket portion or housing as described in further detail below; likewise, annular pressure bleeder 352 may be retrieved by (the same or another) wireline from the pocket portion or housing.

In accordance with one or more embodiments, well control system 326 may include a function of pressure monitoring 355, configured essentially in any suitable manner, to monitor and measure pressure within the TCA 350 and inside production tubing 346, and to determine or track any differential between the two measured pressures. Such measurements can be utilized with one or more embodiments herein, for instance, to determine a suitable time to remove or retrieve the annular pressure bleeder 352.

Figure 4:
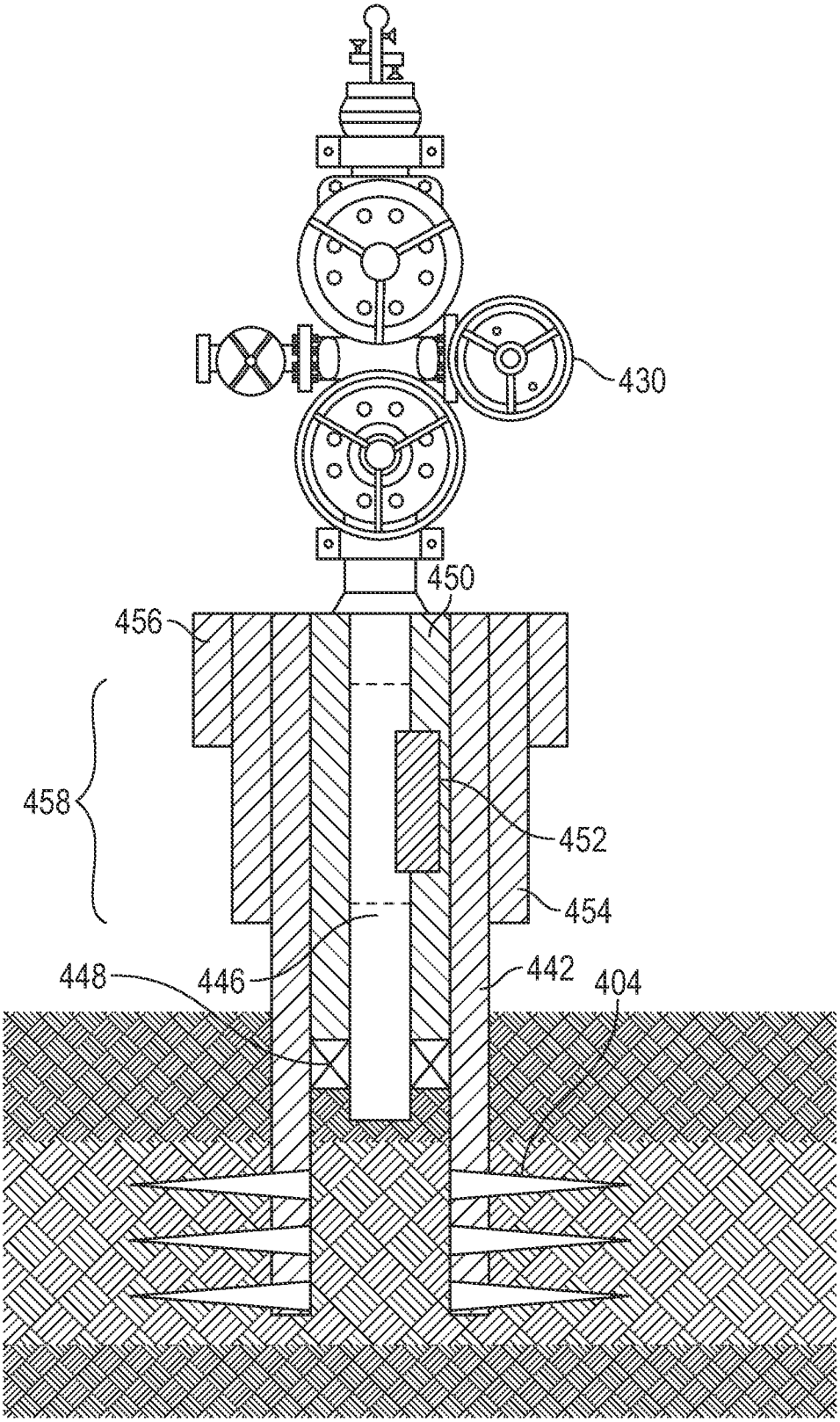
FIG. 4 schematically illustrates, in cross-sectional elevational view, a working example of a production wellbore and related components, in accordance with one or more embodiments.

FIG. 4 schematically illustrates, in elevational view, a working example of a production wellbore and related components, in accordance with one or more embodiments. Components analogous to those shown in FIG. 3 are indicated by reference numerals advanced by 100. Thus, as shown, a completed well includes casing 442 cemented into place, which may also be referred to as a "production casing". Other casings may also be included, such as surface casing 454 disposed adjacent to, and radially outward from, production casing 442, and conductor casing 456 disposed adjacent to, and radially outward from, surface casing 454. Production tubing 446 is also shown, for recovering hydrocarbons from formation rock (or other subsurface region) 404 and is nested coaxially within the production casing 442. Further, packer 448 seals the TCA 450 that is located between the production casing 442 and production tubing 346. Also illustrated is a wellhead 430, that may function and be configured analogously to the wellhead 130 that is are described and illustrated with respect to FIGS. 1-2.

In accordance with one or more embodiments, annular pressure bleeder 452 may be installed in production tubing 446 in a manner to be in fluid communication with the TCA 450. Particularly, production tubing 446 may include a pup joint 458 in which the annular pressure bleeder 452 may be selectively installed (or mounted) and retrieved (e.g., via a wireline) at a predetermined time, such as during well completion. The pup joint 458, axially delineated in the figure by dashed line segments merely for illustrative purposes, is a shorter axial segment of tubing that can be included as a portion of the longer string of production tubing 446. Generally, dimensions of the pup joint 458, such as diameter and axial length, can vary from well to well and can be tailored to physical dimensions or characteristics of the well completion at hand. By way of an illustrative and non-restrictive example, the pup joint 458 may have an outer diameter (OD) of about 4.5 inches and an axial length of about 8 feet. By way of other illustrative and non-restrictive examples, the pup joint 458 may have an OD of about 2.375, about 2.875 or about 3.5 inches. Additionally, by way of a general illustrative and non-restrictive example, the pup joint 458 may have an axial length of between about 4 and about 10 feet. A working example of a pup joint 458 and related components is described below.

Figure 5:
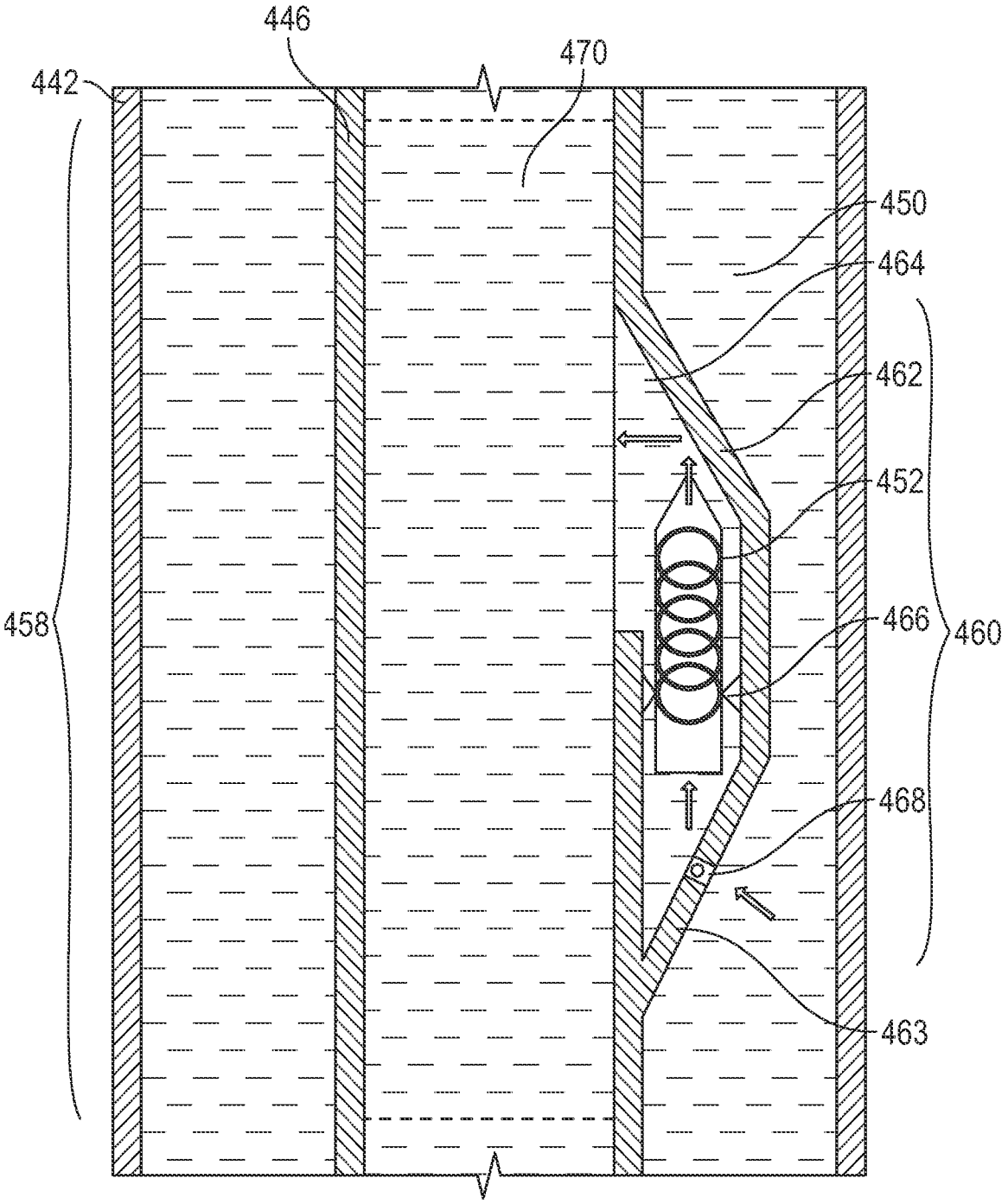
FIG. 5 schematically illustrates, in cross-sectional elevational view, the pup joint in the production wellbore depicted in FIG. 4, in accordance with one or more embodiments.

FIG. 5 schematically illustrates, in cross-sectional elevational view, the pup joint 458 in the production wellbore depicted in FIG. 4, in accordance with one or more embodiments. As shown, pup joint 458 may include a pocket portion 460 that is integral with the pup joint 458 and protrudes radially outwardly from the same. (Here, as well, pup joint 458 is axially delineated in the figure by dashed line segments merely for illustrative purposes.) The pocket portion 460 may also be referred to as a "side pocket", "mandrel", "side pocket mandrel" or "housing". The pocket portion 460 is defined by an outer wall 462, a partial inner wall 463 and a volume 464 defined within the outer wall 462 and partial inner wall 463. Thus, a gap or opening between an axially upper (or uphole) end of the partial inner wall 463 and a junction of the production tubing 446 with an axially upper (or uphole) end of the outer wall 462 ensures fluid communication between the volume 464 and the interior of production tubing 446.

The outer wall 462 of pocket portion 460 may be shaped and dimensioned in essentially any suitable manner; here, it is shown as including upper and lower portions that are angled away from a central longitudinal axis of the production tubing 446 and a central portion, parallel to the central longitudinal axis, that interconnects the upper and lower portions. With respect to the central longitudinal axis of the production tubing 446, and by way of an illustrative and non-restrictive example, the outer wall 462 of pocket portion 460 may extend circumferentially about 30 degrees. As such, the upper and lower portions of outer wall 462 may be generally frustoconical in shape with respect to the central longitudinal axis and the central portion of outer wall 462 may be generally cylindrical in shape with respect to the central longitudinal axis. With such a general shape and configuration for each of the upper, lower and central portions of outer wall 462, better stress distribution can be ensured. Each of the upper, lower and central portions of outer wall 462 may then taper toward the outer cylindrical surface of production tubing 446 (or pup joint 458) along a circumferential direction, or may include walls that run in a radial direction, or other direction, to join the outer cylindrical surface of production tubing 446 (or pup joint 458).

In accordance with one or more embodiments, annular pressure bleeder 452 may be generally cylindrical in shape and may be selectively installed within the volume 464 of pocket portion 460 via a wireline, and may also be selectively retrieved via a wireline. Annular pressure bleeder 452 may also include a standard wireline fish neck to facilitate its retrieval by a wireline. Thus, during installation, a lower portion of annular pressure bleeder 452 may be directed into the volume 464 and then inserted into a setting profile 466 that creates a form-fit for seating the annular pressure bleeder 452. Setting profile 466 may be embodied in essentially any suitable manner, for instance, via two protruding ridges that extend in a circumferential direction and are each mounted, respectively, on a radially outward side of partial inner wall 463 and a radially inward side of outer wall 462. In accordance with at least one variant, setting profile 466 may be ring-shaped and may have an inner diameter that is sufficient for accommodating an outer diameter of annular pressure bleeder 452 via a form-fit.

In accordance with one or more embodiments, the outer wall 462 of pocket portion 460 may include a one-way check valve 468 disposed therethrough. The one-way check valve 462, which may be pre-installed as an integral part of the pocket portion 460 and thus of the pup joint 458, may be configured to admit fluid solely from the TCA 450 into the volume 464 of pocket portion 460, and thus into the interior of production tubing 446. Further, the one-way check valve 468 may be configured to permit fluid flow from the TCA 450 solely in the presence of a positive pressure differential between the TCA 450 and the volume 464 of pocket portion 460 (and thus of the interior of production tubing 446). Thus, the one-way check valve 468 can ensure that fluid 470 contained within production tubing 446 (e.g., oil or one or more other reservoir fluids) cannot migrate into the TCA 450. It should also be understood that essentially any suitable valve arrangement may be provided that functions analogously to the one-way check valve 468. Thus, a "valve arrangement" as broadly understood herein may be embodied by a single one-way check valve, a plurality of one-way check valves, or essentially any physical arrangement that functions analogously to a single one-way check valve or a plurality of one-way check valves.

In accordance with one or more embodiments, with the annular pressure bleeder 452 set in place as shown, fluid may then migrate from the TCA 450 and through the pressure bleeder 452 into the volume 464 of pocket portion 460 and the interior of production tubing 446, generally as indicated by the arrows. Additionally, the pocket portion 460, pressure bleeder 452 and setting profile 466 may be configured and dimensioned such that the pressure bleeder 452 has a plugging or blocking effect and permits the flow of fluid only through the pressure bleeder 452. However, the pressure bleeder 452 may also be configured to be pre-set so as to admit a flow of fluid therethrough, in the general direction indicated by the arrows, above a predetermined threshold pressure. Thus, while the one-way check valve 468 may be configured to admit fluid from the TCA 450 into the volume 464 of pocket portion 460 merely in the presence of any positive pressure differential as noted, the threshold pressure can be set to be a higher, even considerably higher, positive pressure differential. The threshold pressure to which annular pressure bleeder 452 is set may vary from well to well, based on the operating context and other conditions at a well. However, it may be related to a known flowing well head pressure (FWHP); thus, by way of illustrative and non-restrictive example, the threshold pressure may be about FWHP+200 psi.

In accordance with one or more embodiments, the pressure bleeder 452 may be retrieved by a wireline once a determination is made that its use is no longer necessary or prudent (e.g., as indicated at 353 in FIG. 3). At the same time, pressure bleeder 452 may similarly be retrieved by a wireline to be reset if a change in well condition, such as a change in FWHP, is detected. Thus, for example, these determinations may be made by monitoring pressure differentials between TCA 450 and the interior of production tubing 446 over a period of time, e.g., via pressure monitoring 355 provided by well control system 326 as shown in FIG. 3. By way of an illustrative and non-restrictive example, a determination may be made to reset the threshold pressure of the pressure bleeder 452 (e.g., originally 1000 psi based on a FWHP of 800 psi plus 200 psi), if the FWHP drops or increases. The pressure bleeder 452 may also be retrieved by a wireline for other practical reasons, e.g., if there is a need to pump fluid from the surface through the TCA 450 and into the interior of production tubing 446, e.g., solely through the check valve 468.

In accordance with one or more embodiments, the pocket portion 460 may be located, or configured, differently from the arrangement shown in FIG. 5. Thus, by way of illustrative and non-restrictive example, the pocket portion 460 may be located in a portion of production tubing 446 other than a pup joint, e.g., in a longer (or "main" or "primary") section of production tubing 446. Additionally, by way of illustrative and non-restrictive example, pocket portion 460 may be configured such that it does not include a partial inner wall 463. In such a configuration, pocket portion 460 may include a recessed portion, at an axially downhole section of outer wall 462, into which the pressure bleeder 452 may be seated via a form-fit, and in which the one-way check valve 468 may be disposed.

Figure 6A:
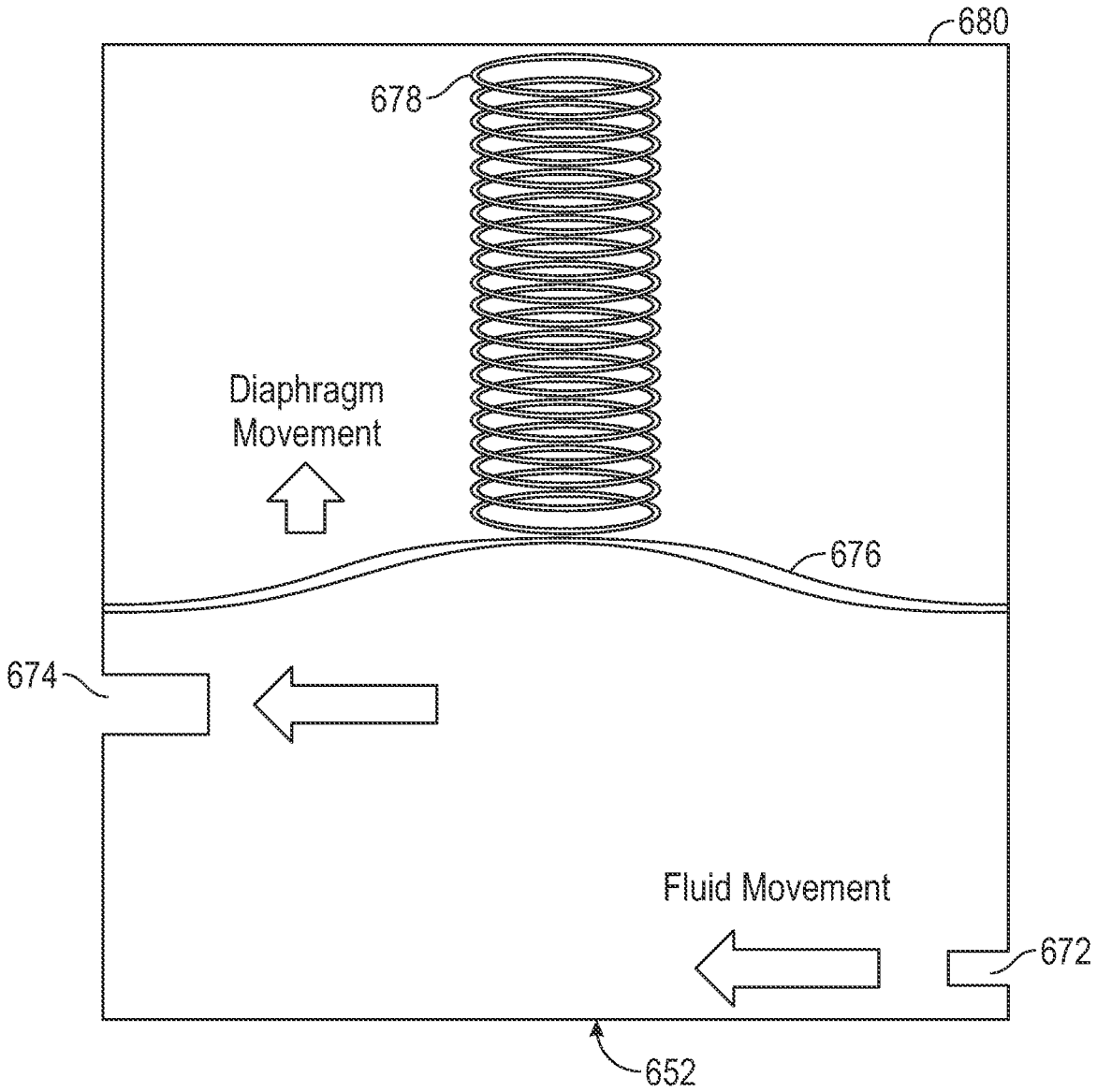
FIG. 6A schematically illustrates in cross-sectional elevational view, an annular pressure bleeder and related components in an open position, in accordance with one or more embodiments.

FIG. 6A schematically illustrates in cross-sectional elevational view, an annular pressure bleeder 652 and related components in an open position, in accordance with one or more embodiments. Pressure bleeder 652 may be utilized in accordance with the embodiments described and contemplated with respect to FIGS. 4 and 5, and may be considered to be analogous to the pressure bleeder 452 there depicted.

In accordance with one or more embodiments, pressure bleeder 652 includes an inlet 672 and an outlet 674. Fluid originating and flowing from a TCA (such as from a TCA 450 and check valve 468 as shown in FIG. 5) thus may enter the pressure bleeder 652 via inlet 672, while outlet 674 may be in fluid communication with the interior of production tubing (such as production tubing 446, and via the volume 464 within pocket portion 460, as shown in FIG. 5). A diaphragm 676 may extend across an interior (i.e., across the entire inner diameter) of pressure bleeder 652, and one or more springs 678 may extend between the diaphragm 676 and an axially uphole wall 680 of pressure bleeder 652. Thus, in the presence of a sufficient pressure differential between inlet 672 and outlet 674, accounting for a predetermined threshold pressure differential between a TCA and the interior of production tubing as discussed heretofore, diaphragm 676 and spring 678 may displace axially in an uphole direction such that the diaphragm 676 does not impede the flow of fluid between inlet 672 and outlet 674. In this connection, diaphragm 676 and spring 678 may be configured to pre-set the predetermined threshold pressure at which diaphragm 676 permits a flow of fluid from a TCA and the interior of production tubing (such as, between the TCA 450 and production tubing 446 shown in FIG. 5).

Figure 6B:
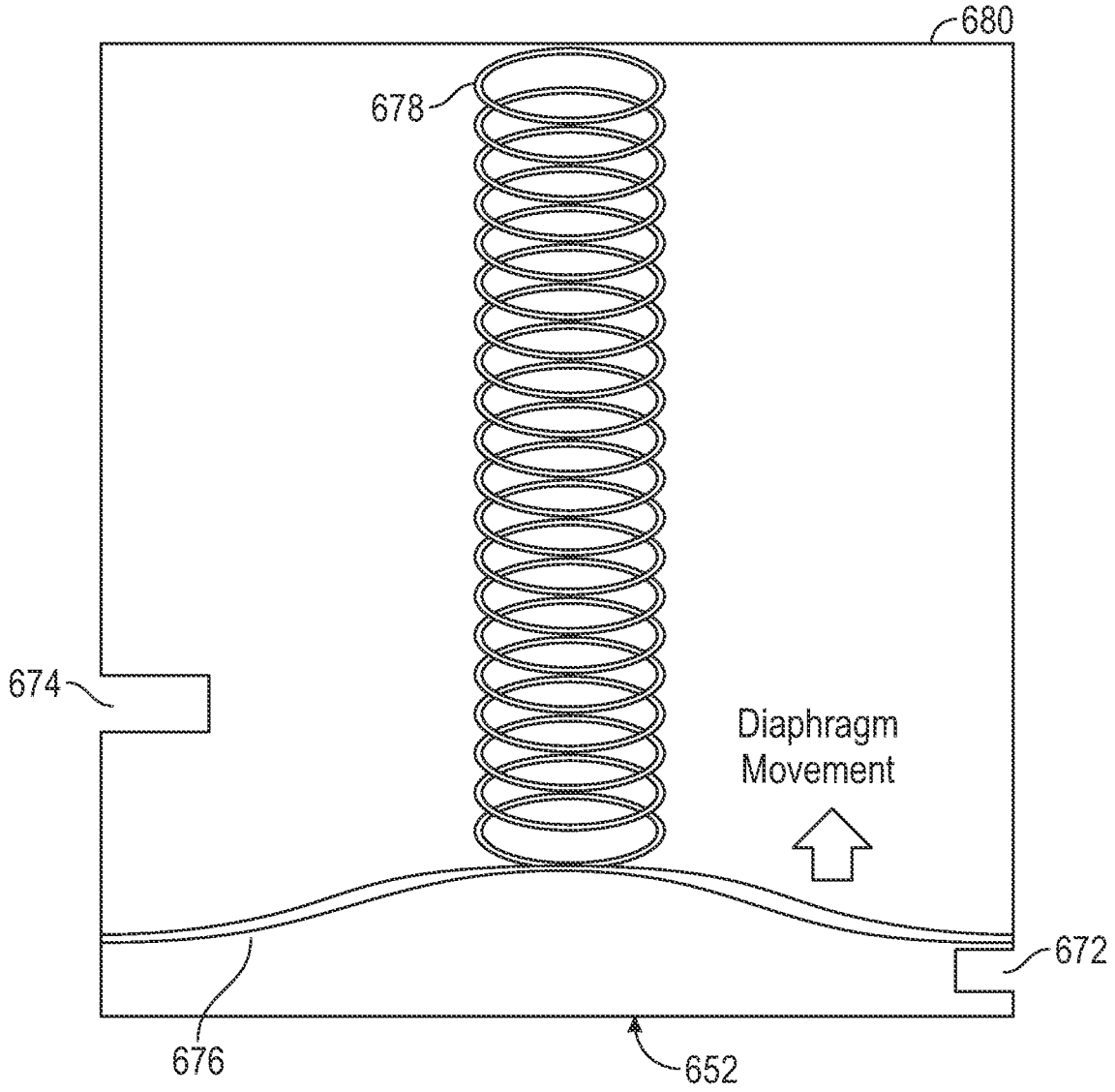
FIG. 6B depicts the annular pressure bleeder and related components in a closed position, in accordance with one or more embodiments.

FIG. 6B provides essentially the same view as FIG. 6A, but depicts the annular pressure bleeder 652 and related components in a closed position, in accordance with one or more embodiments. Thus, once the pressure differential between a TCA and the interior of production tubing decreases below the predetermined threshold pressure as mentioned, the biasing effect of spring (or springs) 678 is no longer counteracted and the diaphragm 676 may refer to a position, as shown, where it does prevent the flow of fluid between inlet 672 and outlet 674.

In accordance with one or more embodiments, any of a great variety of mechanisms could be employed for presetting the threshold pressure for a pressure bleeder, such as that indicated at 652 in FIGS. 6A and 6B. Thus, by way of illustrative and non-restrictive example, the diaphragm 676 or spring 678, or both, could be suitably set or fixed physically in a manner to accurately set a desired threshold pressure. For instance, this could involve pre-stressing the spring 678 by altering or limiting an initial axial position of diaphragm 676. An alternative mechanism may involve the use of a bellows in place of spring 678, that could be charged with nitrogen or another inert gas.

Figure 7:
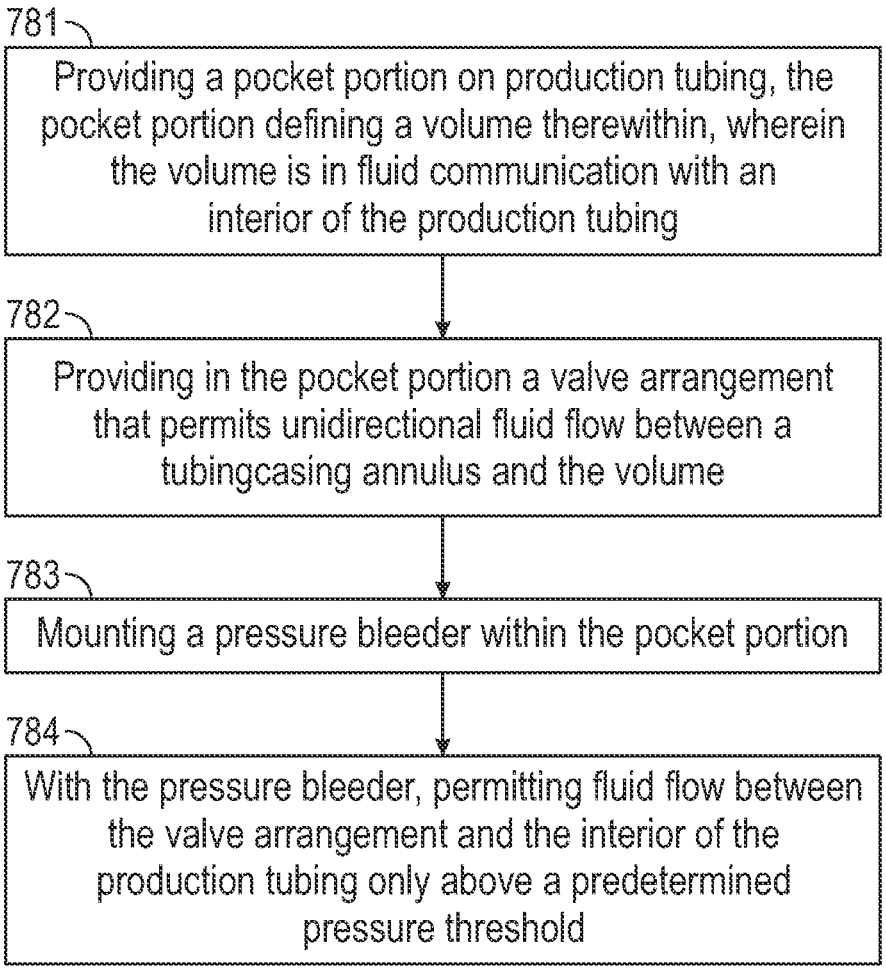
FIG. 7 shows a flowchart of a method in accordance with one or more embodiments.

FIG. 7 shows a flowchart of a method, as a general overview of steps which may be carried out in accordance with one or more embodiments described or contemplated herein. Specifically, FIG. 7 describes a method of mounting and utilizing a pressure bleeder. One or more blocks in FIG. 7 may be performed using one or more components as described in FIGS. 1-6 and 8. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

As such, in accordance with one or more embodiments, a pocket portion is provided on production tubing, the pocket portion defining a volume therewithin, wherein the volume is in fluid communication with an interior of the production tubing (Step 781). In accordance with an illustrative example, this can correspond to the pocket portion 460, and its volume 464, described and illustrated with respect to FIG. 5. In the pocket portion, a valve arrangement is provided that permits unidirectional fluid flow between a tubing-casing annulus and the volume (Step 782). In accordance with an illustrative example, this can correspond to the one-way check valve 468 described and illustrated with respect to FIG. 5.

Additionally, in accordance with one or more embodiments, a pressure bleeder is mounted within the pocket portion (Step 783). In accordance with an illustrative example, this can correspond to the pressure bleeder 452 described and illustrated with respect to FIG. 5. Using the pressure bleeder, fluid flow is permitted between the valve arrangement and the interior of the production tubing only above a predetermined threshold pressure (Step 784). In accordance with an illustrative example, this can correspond to the flow depicted with arrows in FIG. 5, between one-way check valve 468 and the interior of production tubing 446.

From the foregoing, it can be appreciated that, in accordance with one or more embodiments, an annular pressure bleeder as broadly contemplated herein can bleed off excess pressure from a TCA automatically, and in a manner that is safe and that does not adversely affect production. Further, as TCA fluid is vented to the wellbore via the interior of production tubing, and not to atmosphere, the process is also much more environmentally friendly than conventional methods. Additionally, completion failure is averted by forestalling the potential burst or collapse of the production tubing, casing or other components, while the automatic triggering of bleed-off helps mitigate or avoid any excess operating costs tied to human intervention.

Figure 8:
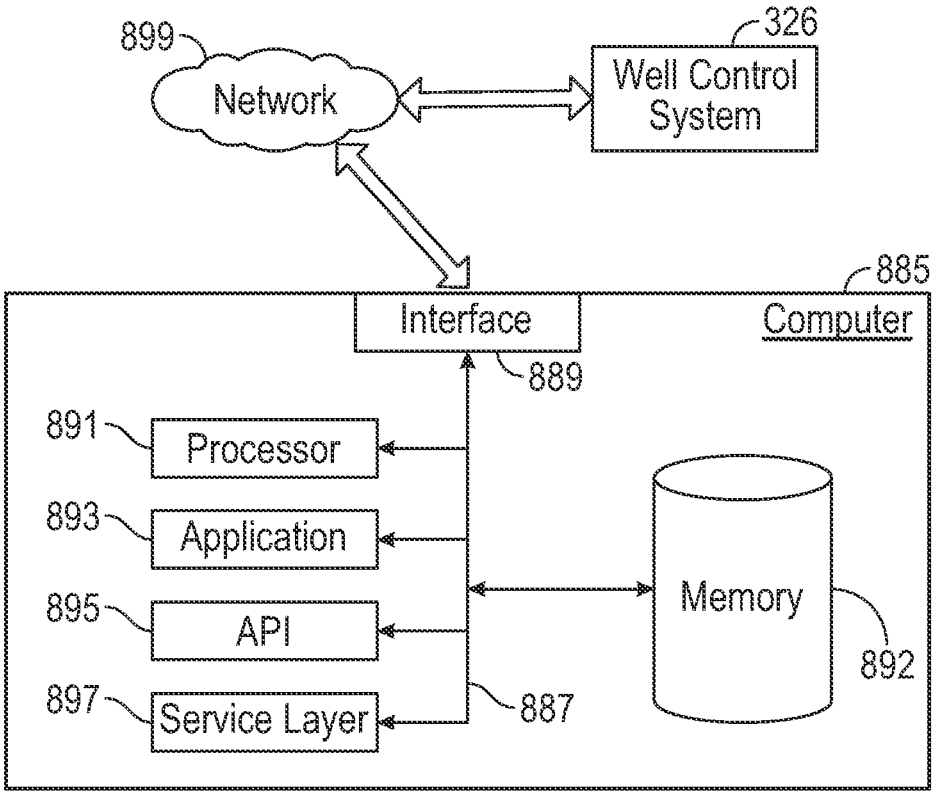
FIG. 8 schematically illustrates a computing device and related components, in accordance with one or more embodiments.

FIG. 8 schematically illustrates a computing device and related components, in accordance with one or more embodiments. As such, FIG. 8 generally depicts a block diagram of a computer system 885 used to provide computational functionalities associated with described algorithms, methods, functions, processes, flows, and procedures as described in this disclosure, according to one or more embodiments. In this respect, computer 885 may interface with a well control system 326 such as that described and illustrated with respect to FIG. 3, either directly (e.g., via hard-wired connection) or over an internal or external network 899. Alternatively, the computer 885 illustrated in FIG. 8 may correspond directly to the well control system 326 described and illustrated with respect to FIG. 3.

In accordance with one or more embodiments, the illustrated computer 885 is intended to encompass any computing device such as a server, desktop computer, laptop/notebook computer, wireless data port, smart phone, personal data assistant (PDA), tablet computing device, one or more processors within these devices, or any other suitable processing device, including both physical or virtual instances (or both) of the computing device. Additionally, the computer 885 may include a computer that includes an input device, such as a keypad, keyboard, touch screen, or other device that can accept user information, and an output device that conveys information associated with the operation of the computer 885, including digital data, visual, or audio information (or a combination of information), or a GUI.

The computer 885 can serve in a role as a client, network component, a server, a database or other persistency, or any other component (or a combination of roles) of a computer system for performing the subject matter described in the instant disclosure. The illustrated computer 885 is communicably coupled with a network 899. In some implementations, one or more components of the computer 885 may be configured to operate within environments, including cloud-computing-based, local, global, or other environment (or a combination of environments).

At a high level, the computer 885 is an electronic computing device operable to receive, transmit, process, store, or manage data and information associated with the described subject matter. According to some implementations, the computer 885 may also include or be communicably coupled with an application server, e-mail server, web server, caching server, streaming data server, business intelligence (BI) server, or other server (or a combination of servers).

The computer 885 can receive requests over network 899 from a client application (for example, executing on another computer 885) and responding to the received requests by processing the said requests in an appropriate software application. In addition, requests may also be sent to the computer 885 from internal users (for example, from a command console or by other appropriate access method), external or third-parties, other automated applications, as well as any other appropriate entities, individuals, systems, or computers.

Each of the components of the computer 885 can communicate using a system bus 887. In some implementations, any or all of the components of the computer 885, both hardware or software (or a combination of hardware and software), may interface with each other or the interface 889 (or a combination of both) over the system bus 887 using an application programming interface (API) 895 or a service layer 897 (or a combination of the API 895 and service layer 897. The API 895 may include specifications for routines, data structures, and object classes. The API 895 may be either computer-language independent or dependent and refer to a complete interface, a single function, or even a set of APIs. The service layer 897 provides software services to the computer 885 or other components (whether or not illustrated) that are communicably coupled to the computer 885. The functionality of the computer 885 may be accessible for all service consumers using this service layer. Software services, such as those provided by the service layer 897, provide reusable, defined business functionalities through a defined interface. For example, the interface may be software written in JAVA, C++, or other suitable language providing data in extensible markup language (XML) format or another suitable format. While illustrated as an integrated component of the computer 885, alternative implementations may illustrate the API 895 or the service layer 897 as stand-alone components in relation to other components of the computer 885 or other components (whether or not illustrated) that are communicably coupled to the computer 885. Moreover, any or all parts of the API 895 or the service layer 897 may be implemented as child or sub-modules of another software module, enterprise application, or hardware module without departing from the scope of this disclosure.

The computer 885 includes an interface 889. Although illustrated as a single interface 889 in FIG. 8, two or more interfaces 889 may be used according to particular needs, desires, or particular implementations of the computer 885. The interface 889 is used by the computer 885 for communicating with other systems in a distributed environment that are connected to the network 899. Generally, the interface 889 includes logic encoded in software or hardware (or a combination of software and hardware) and operable to communicate with the network 899. More specifically, the interface 889 may include software supporting one or more communication protocols associated with communications such that the network 899 or interface's hardware is operable to communicate physical signals within and outside of the illustrated computer 885.

The computer 885 includes at least one computer processor 891. Although illustrated as a single computer processor 891 in FIG. 8, two or more processors may be used according to particular needs, desires, or particular implementations of the computer 885. Generally, the computer processor 891 executes instructions and manipulates data to perform the operations of the computer 885 and any algorithms, methods, functions, processes, flows, and procedures as described in the instant disclosure.

The computer 885 also includes a memory 892 that holds data for the computer 885 or other components (or a combination of both) that can be connected to the network 899. For example, memory 892 can be a database storing data consistent with this disclosure. Although illustrated as a single memory 892 in FIG. 8, two or more memories may be used according to particular needs, desires, or particular implementations of the computer 885 and the described functionality. While memory 892 is illustrated as an integral component of the computer 885, in alternative implementations, memory 892 can be external to the computer 885.

The application 893 is an algorithmic software engine providing functionality according to particular needs, desires, or particular implementations of the computer 885, particularly with respect to functionality described in this disclosure. For example, application 893 can serve as one or more components, modules, applications, etc. Further, although illustrated as a single application 893, the application 893 may be implemented as multiple applications 893 on the computer 885. In addition, although illustrated as integral to the computer 885, in alternative implementations, the application 893 can be external to the computer 885.

There may be any number of computers 885 associated with, or external to, a computer system containing computer 885, wherein each computer 885 communicates over network 899. Further, the term "client," "user," and other appropriate terminology may be used interchangeably as appropriate without departing from the scope of this disclosure. Moreover, this disclosure contemplates that many users may use one computer 885, or that one user may use multiple computers 885.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. An apparatus comprising:

a pocket portion disposed on production tubing, the pocket portion defining a volume therewithin, wherein the volume is in fluid communication with an interior of the production tubing;

the pocket portion including a valve arrangement that permits unidirectional fluid flow between a tubing-casing annulus and the volume, solely in the presence of a positive pressure differential between the tubing-casing annulus and the volume; and a pressure bleeder configured to be selectively mounted within the pocket portion;

wherein, when the pressure bleeder is selectively mounted within the pocket portion:

the valve arrangement directs fluid flow from the tubing-casing annulus to a portion of the volume outside of the pressure bleeder; and fluid flow is directed, through the pressure bleeder, from the portion of the volume outside of the pressure bleeder to the interior of the production tubing and only above a predetermined threshold pressure, wherein the pressure bleeder comprises:

an inlet and an outlet;

a diaphragm extending across an entire inner diameter of the pressure bleeder; and one or more springs extending from the diaphragm, wherein, in the presence of a pressure differential above the predetermined threshold pressure, the diaphragm and one or more springs displace axially in an uphole direction such that the diaphragm does not impede fluid flow between the inlet and the outlet, wherein the predetermined threshold pressure is pre-set by pre-stressing the one or more springs, and the diaphragm prevents fluid flow between the inlet and the outlet when the pressure differential is below the predetermined threshold pressure.

2. The apparatus according to claim 1, wherein:

the production tubing includes a pup joint, and the pocket portion is disposed on the pup joint.

3. The apparatus according to claim 1, wherein the valve arrangement comprises a one-way check valve.

4. The apparatus according to claim 3, wherein:

the pocket portion includes an outer wall; and the one-way check valve is disposed through the outer wall.

5. The apparatus according to claim 1, wherein the valve arrangement prevents fluid flow from the volume to the tubing-casing annulus.

6. The apparatus according to claim 1, wherein the pocket includes a setting profile for seating the pressure bleeder via a form-fit, when the pressure bleeder is selectively mounted within the pocket portion.

7. The apparatus according to claim 1, wherein the pressure bleeder is configured to be pre-set to permit fluid flow between the valve arrangement and the interior of the production tubing above the predetermined threshold pressure.

8. The apparatus according to claim 1, wherein the pressure bleeder includes a portion that facilitates selective retrieval by a wireline away from the pocket portion.

9. The apparatus according to claim 1, wherein the predetermined threshold pressure is adjusted based on a flowing well head pressure change.

10. The apparatus according to claim 9, wherein the flowing well head pressure change is greater than 200 psi.

11. A method comprising:

providing a pocket portion on production tubing, the pocket portion defining a volume therewithin, wherein the volume is in fluid communication with an interior of the production tubing;

providing in the pocket portion a valve arrangement that permits unidirectional fluid flow between a tubing-casing annulus and the volume, solely in the presence of a positive pressure differential between the tubing-casing annulus and the volume;

selectively mounting a pressure bleeder within the pocket portion;

wherein, when the pressure bleeder is selectively mounted within the pocket portion:

the valve arrangement directs fluid flow from the tubing-casing annulus to a portion of the volume outside of the pressure bleeder; and fluid flow is directed, through the pressure bleeder, from the portion of the volume outside of the pressure bleeder to the interior of the production tubing and only above a predetermined threshold pressure, wherein the pressure bleeder comprises:

an inlet and an outlet;

a diaphragm extending across an entire inner diameter of the pressure bleeder; and one or more springs extending from the diaphragm, wherein, in the presence of a pressure differential above the predetermined threshold pressure, the diaphragm and one or more springs displace axially in an uphole direction such that the diaphragm does not impede fluid flow between the inlet and the outlet, wherein the predetermined threshold pressure is pre-set by pre-stressing the one or more springs, and the diaphragm prevents fluid flow between the inlet and the outlet when the pressure differential is below the predetermined threshold pressure.

12. The method according to claim 11, further comprising:

providing a pup joint with the production tubing, wherein the pocket portion is disposed on the pup joint.

13. The method according to claim 11, wherein providing the valve arrangement comprises providing a one-way check valve.

14. The method according to claim 13, wherein:

the pocket portion includes an outer wall; and the one-way check valve is disposed through the outer wall.

15. The method according to claim 11, further comprising:

with the valve arrangement, preventing fluid flow from the volume to the tubing-casing annulus.

16. The method according to claim 11, wherein mounting the pressure bleeder comprises seating the pressure bleeder via a form-fit in a setting profile in the pocket portion.

17. The method according to claim 11, further comprising pre-setting the pressure bleeder to permit fluid flow between the valve arrangement and the interior of the production tubing above the predetermined threshold pressure.

18. The method according to claim 11, wherein mounting the pressure bleeder comprises installing the pressure bleeder in the pocket portion via a wireline.

19. The method according to claim 11, further comprising retrieving the pressure bleeder away from the pocket portion via a wireline.

20. The method according to claim 11, wherein the predetermined threshold pressure is adjusted based on a flowing well head pressure change.

* * * * *